US005626258A

United States Patent [19]

Maiorino

[11] Patent Number: 5,626,258

[45] Date of Patent: May 6, 1997

[54] PAINT LID FOR USE WITH A BRUSH

[76] Inventor: Anthony E. Maiorino, 15 Timothy Dr., North Haven, Conn. 06473-3530

[21] Appl. No.: 522,072

[22] Filed: Aug. 31, 1995

[51] Int. Cl.[6] ..... B65D 25/38

[52] U.S. Cl. ..... 220/695; 220/699; 220/700; 220/701; 222/109; 222/570

[58] Field of Search ..... 220/694, 695, 220/698, 699, 700, 701, 711, 710, 713, 354; 222/92, 109, 569, 570

[56] References Cited

U.S. PATENT DOCUMENTS

| | | | |
|---|---|---|---|
| 2,606,694 | 8/1952 | Galletta | 220/711 X |
| 2,646,193 | 7/1953 | Best | 220/701 X |
| 2,786,614 | 3/1957 | Giusto | 222/570 |
| 2,996,215 | 8/1961 | Giza | 220/701 |
| 3,894,650 | 7/1975 | Crump | 220/701 |
| 3,980,213 | 9/1976 | Ramsay | 220/701 X |
| 4,009,802 | 3/1977 | Hayduchok | 220/701 X |
| 4,228,916 | 10/1980 | Weingardt | 220/354 |
| 4,240,568 | 12/1980 | Pool | 220/701 X |
| 4,466,552 | 8/1984 | Butterworth et al. | 220/354 |
| 4,619,372 | 10/1986 | McFarland | 220/713 |
| 4,949,884 | 8/1990 | Dahl | 222/570 |
| 5,059,319 | 10/1991 | Welsh | 220/354 X |
| 5,160,067 | 11/1992 | Luber | 220/698 X |

*Primary Examiner*—Allan N. Shoap
*Assistant Examiner*—Robin A. Hylton

[57] ABSTRACT

A device for facilitating ease of dispensing of paint from a container utilizing a brush. The inventive device includes a rim engaging assembly for coupling to an upper rim of a paint can. A fluid guide assembly extends across a portion of the rim engaging assembly for guiding fluid from a brush scraped against the fluid guide back into the can, and can also be utilized for facilitating pouring of paint from the can in a directed stream over the rim of the can.

1 Claim, 3 Drawing Sheets

FIG 5
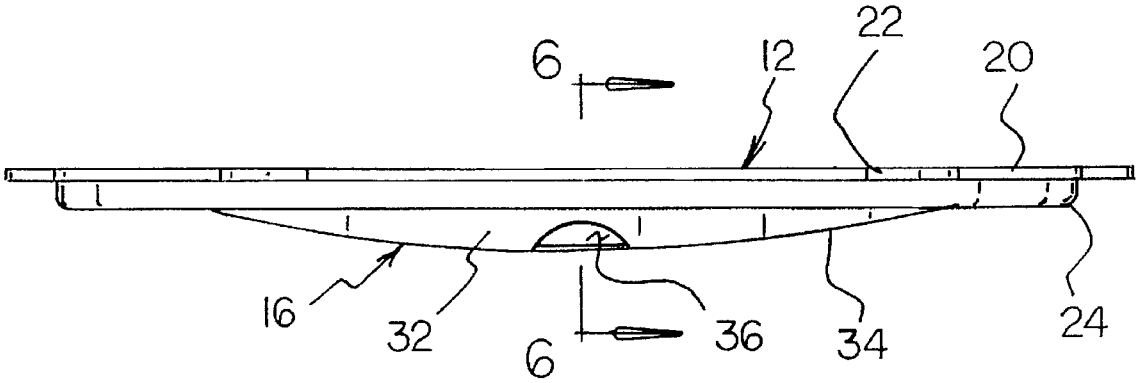
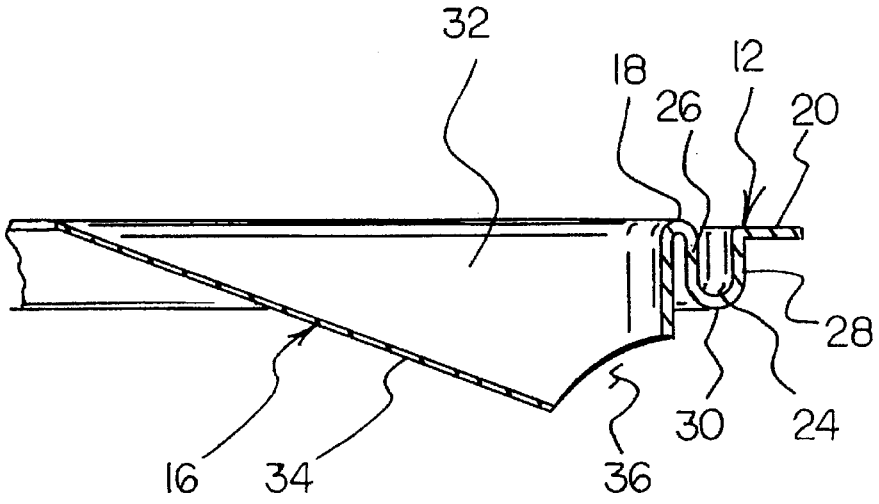
FIG 6

PAINT LID FOR USE WITH A BRUSH

BACKGROUND OF THE INVENTION

1. Field of the Invention

The present invention relates to fluid guides and more particularly pertains to a paint container lid for facilitating ease of dispensing of paint on a brush from a container.

2.Description of the Prior Art

The use of fluid guides is known in the prior art. More specifically, fluid guides heretofore devised and utilized are known to consist basically of familiar, expected and obvious structural configurations, notwithstanding the myriad of designs encompassed by the crowded prior art which have been developed for the fulfillment of countless objectives and requirements.

Known prior art fluid guides include U.S. Pat. No. 5,255,814; U.S. Pat. No. 4,949,884; U.S. Pat. No. 5,072,847; U.S. Design Pat. No. 246,892; and U.S. Design Pat. No. 341,318.

While these devices fulfill their respective, particular objectives and requirements, the aforementioned patents do not disclose a paint container lid for facilitating ease of loading a brush or dispensing of paint from a container which includes a rim engaging means for coupling to an upper rim of a paint can, and a fluid guide means extending across a portion of the rim engaging means for guiding fluid from a brush scraped against the fluid guide back into the can which can also be utilized for facilitating pouring of paint from the can in a directed stream over the rim of the can.

In these respects, the paint container lid according to the present invention substantially departs from the conventional concepts and designs of the prior art, and in so doing provides an apparatus primarily developed for the purpose of facilitating ease of dispensing of paint on a brush from a container.

SUMMARY OF THE INVENTION

In view of the foregoing disadvantages inherent in the known types of lids or fluid guides now present in the prior art, the present invention provides a new paint container lid construction wherein the same can be utilized for facilitating ease of dispensing paint from a container on a brush. As such, the general purpose of the present invention, which will be described subsequently in greater detail, is to provide a new paint container lid apparatus and method which has many of the advantages of the fluid guides mentioned heretofore and many novel features that result in a paint container lid which is not anticipated, rendered obvious, suggested, or even implied by any of the prior art fluid guides, either alone or in any combination thereof.

To attain this, the present invention generally comprises a device for facilitating ease of dispensing of paint from a container utilizing either a brush or by pouring. The inventive device includes a rim engaging assembly for coupling to an upper rim of a paint can. A fluid guide assembly extends across a portion of the rim engaging assembly for guiding fluid from a brush scraped against the fluid guide back into the can, and can also be utilized for facilitating pouring of paint from the can in a directed stream over the rim of the can.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new paint container lid apparatus and method which has many of the advantages of the fluid guides mentioned heretofore and many novel features that result in a paint container lid which is not anticipated, rendered obvious, suggested, or even implied by any of the prior art fluid guides, either alone or in any combination thereof.

It is another object of the present invention to provide a new paint container lid which may be easily and efficiently manufactured and marketed.

It is a further object of the present invention to provide a new paint container lid which is of a durable and reliable construction.

An even further object of the present invention is to provide a new paint container lid which is susceptible of a low cost of manufacture with regard to both materials and labor, and which accordingly is then susceptible of low prices of sale to the consuming public, thereby making such paint container lids economically available to the buying public.

Still yet another object of the present invention is to provide a new paint container lid which provides in the apparatuses and methods of the prior art some of the advantages thereof, while simultaneously overcoming some of the disadvantages normally associated therewith.

Still another object of the present invention is to provide a new paint container lid for facilitating ease of dispensing of paint from a container on a brush.

Yet another object of the present invention is to provide a new paint container lid which includes a rim engaging means for coupling to an upper rim of a paint can, and a fluid guide means extending across a portion of the rim engaging means for guiding fluid from a brush scraped against the fluid guide back into the can, and can also be utilized for facilitating pouring of paint from the can in a directed stream over the rim of the can.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an end elevation view taken from line 5—5 of FIG. 4.

FIG. 6 is a cross-sectional view taken along line 6—6 of FIG. 5.

DESCRIPTION OF THE PREFERRED EMBODIMENT

Figure 1:
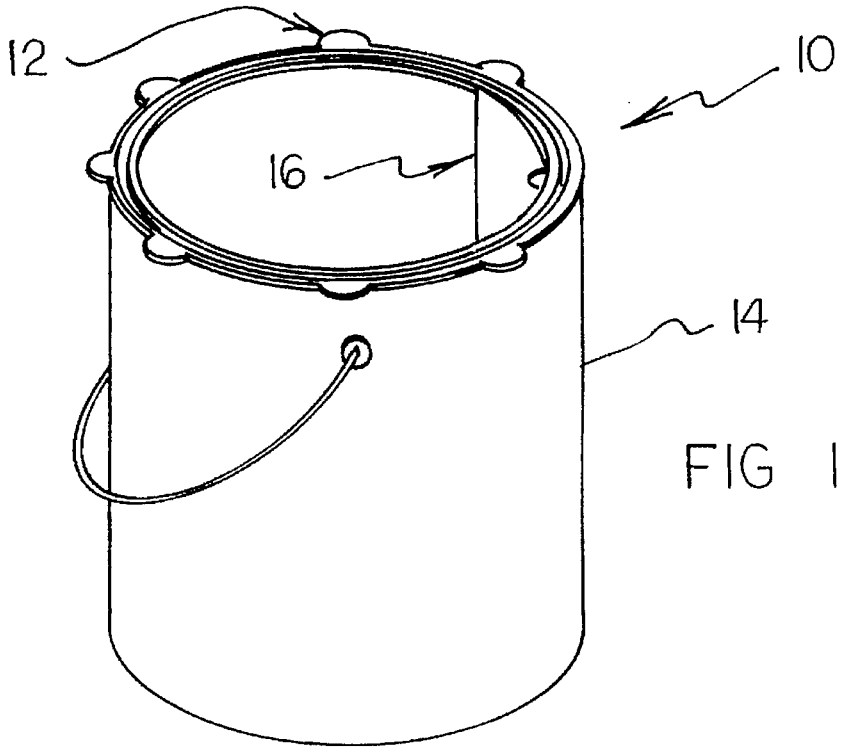
FIG. 1 is an isometric illustration of a paint container lid according to the present invention in use.
Figure 2:
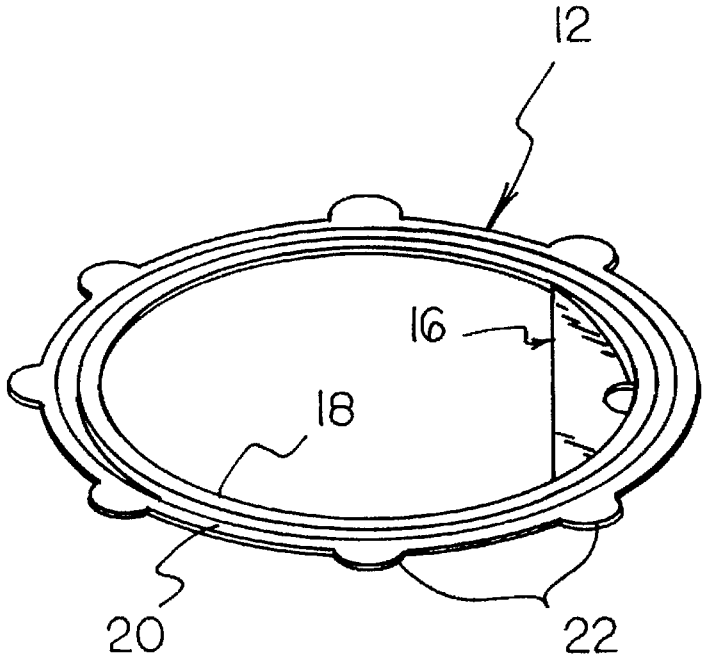
FIG. 2 is an isometric illustration of the invention, per se.
Figure 3:
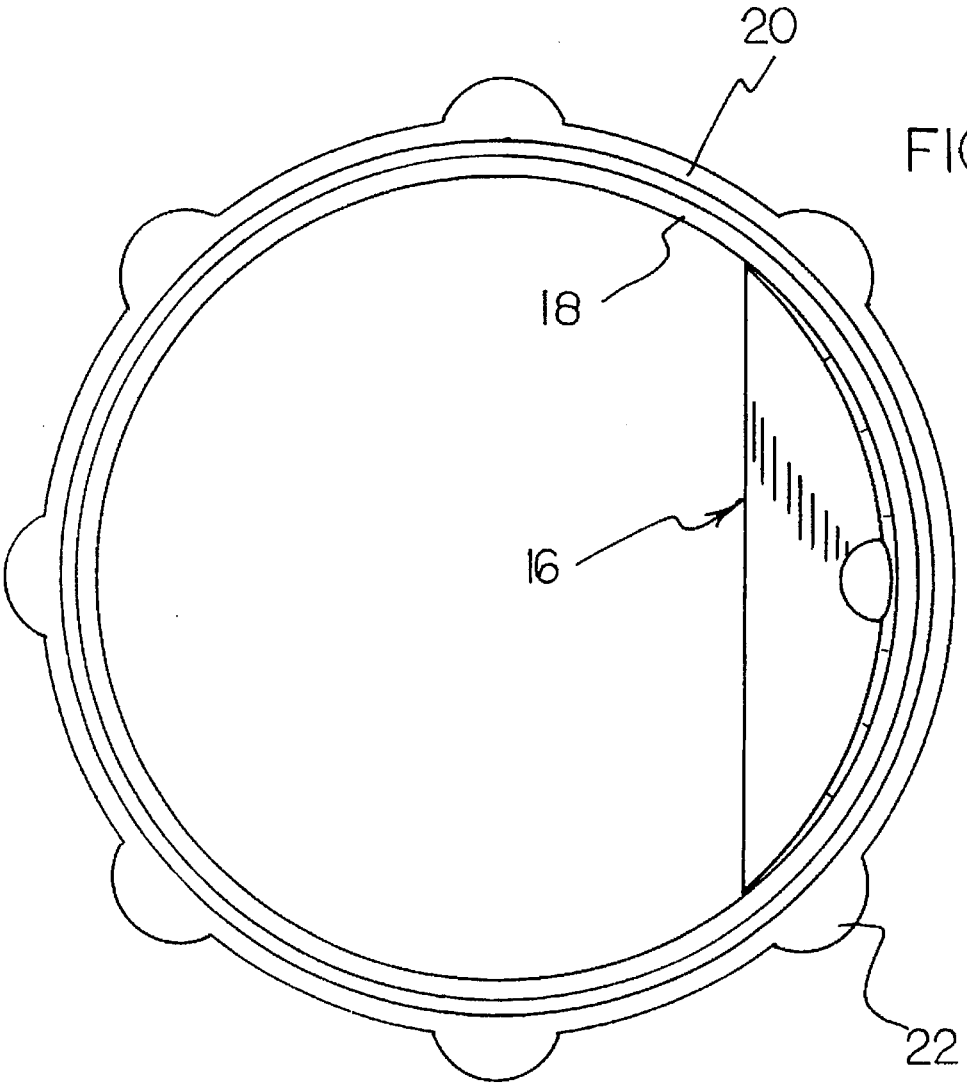
FIG. 3 is a top plan view thereof.
Figure 4:
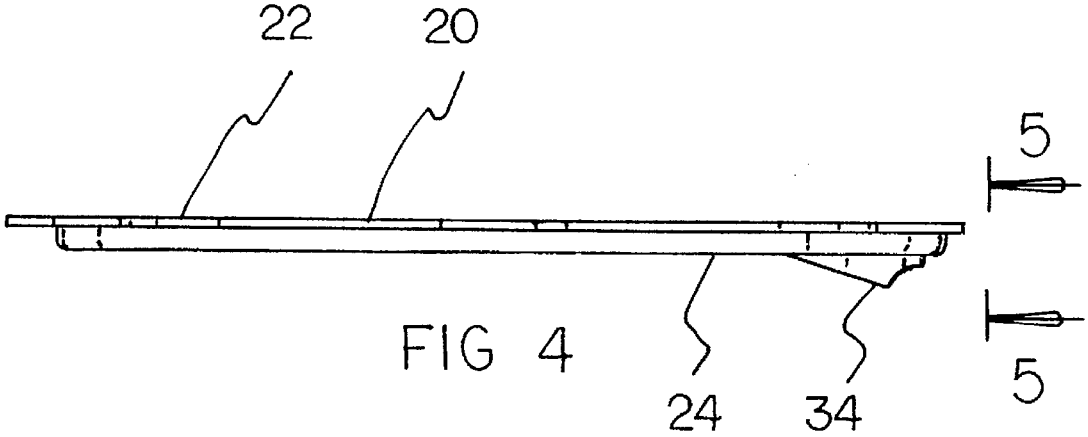
FIG. 4 is a side elevation view of the invention.

With reference now to the drawings, and in particular to FIGS. 1–6 thereof, a new paint container lid embodying the principles and concepts of the present invention and generally designated by the reference numeral 10 will be described.

More specifically, it will be noted that the paint container lid 10 comprises a rim engaging means 12 for coupling to a rim of an open upper end of a paint container 14 as shown in FIG. 1 of the drawings. A fluid guide means 16 is coupled to the rim engaging means 12 and extends across a portion thereof for guiding excess fluid from a brush back into the paint container 14. By this structure, a brush can be dipped into paint within the can and subsequently scraped against the fluid guide, with excess paint from the brush being directed back into the can, thereby precluding unintentional application of the fluid to the rim of the paint container 14 or an exterior thereof.

Referring now to FIGS. 2 through 6 wherein the present invention 10 is illustrated in detail, it can be shown that the rim engaging means 12 of the present invention 10 preferably comprises an inner annular ring 18 concentrically positioned and mounted relative to an outer annular ring 20. A plurality of handling tabs 22 extend from the outer annular ring 20 and are substantially coplanar therewith. The handling tabs 22 are spaced from one another so as to permit for manual manipulation of the device 10 during installation thereof relative to the paint container 14. As shown in FIGS. 5 and 6, the rim engaging means 12 further comprises a compressible annular projection 24 extending between the inner ring 18 and the outer ring 20. The compressible annular projection 24 is operable to be inserted into an annular groove of the upper rim of the paint container 14 so as to secure the device 10 relative thereto. To this end, the compressible annular projection 24 comprises an inner cylindrical member 26 extending substantially orthogonally downward from an outer peripheral edge of the inner annular ring 18. An outer cylindrical member 28 is concentrically positioned relative to the inner cylindrical member 26 and coupled thereto by an integral bend 30 extending between lower annular edges of the cylindrical members 26 and 28. The outer cylindrical member 28 is orthogonally coupled to an inner peripheral edge of the outer annular ring 20 so as to complete a definition of the rim engaging means 12. By this structure, the outer cylindrical member 28 is permitted to articulate relative to the inner cylindrical member 26 as the integral bend 30 resiliently deforms so as to frictionally retain the compressible annular projection 24 within the annular groove of an upper rim of a paint container 14 when the device 10 is utilized as shown in FIG. 1 of the drawings.

As shown in FIGS. 5 and 6, the fluid guide means 16 of the present invention 10 preferably comprises a depending arcuate guide plate 32 which is integrally or otherwise secured to an inner peripheral edge of the inner annular ring 18 and extends downwardly therefrom. An inclined planar guide plate 34 is coupled to and extends along a lower inclined edge of the depending arcuate guide plate 32 substantially as shown in FIG. 6 of the drawings. Accordingly the inclined planar guide plate 34 is oriented so as to reside within a plane oriented at an oblique angle relative to a plane containing the annular rings 18 and 20 of the rim engaging means 12. A dispensing aperture 36 is directed through both the depending arcuate guide plate 32 and the inclined planar guide plate 34 at a juncture of these two components and permits fluid residing within the paint container 14 to be dispensed in a direct stream from the device 10 as the paint container 14 is tilted. By this structure, an individual utilizing the device 10 can dispense paint from the paint container 14 without an unintentional application of paint to the rim or exterior side wall of the paint container.

In use, the paint container lid 10 of the present invention can be easily coupled to an upper rim of a paint container 14 as shown in FIG. 1 of the drawings. The radial spacing of the handling tabs 22 permits an individual to easily apply force to the rim engaging means 12 during coupling and/or decoupling thereof from the paint container 14 about radially spaced portions of the rim engaging means 12. The fluid guide means 16, when the device 10 is coupled to a paint container 14 as shown in FIG. 1, creates a directed stream of paint which flows from the paint container without unintentionally coating the upper rim or exterior surfaces thereof. It should also be noted that the rim engaging means 12 is dimensioned so as to completely extend over the upper rim of the paint container 14 such that a possibility of paint contacting the upper rim is substantially eliminated. The present invention 10 may be integrally stamped from a single piece of sheet metal or like material, but is preferably integrally molded from plastic or other polymeric materials.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A paint container lid comprising:

a rim engaging means having a radially extending edge for coupling to a rim of an open upper end of a container, the rim engaging means comprising an inner annular ring, an outer annular ring concentrically positioned and disposed outwardly of the inner annular ring, a plurality of handling tabs extending from the annular outer ring in a spaced relationship along a peripheral edge thereof and a compressible annular projection extending axially downward between the inner ring and the outer ring, the compressible annular projection comprising an inner cylindrical member extending substantially orthogonally downward from an outer peripheral edge of the inner annular ring; an outer cylindrical member concentrically positioned relative to the inner cylindrical member and being coupled thereto by an integral bend extending between lower annular edges of the cylindrical members, the outer cylindrical member orthogonally coupled to an inner peripheral edge of the outer annular ring, wherein the outer cylindrical member is permitted to articulate relative to the inner cylindrical member as the integral bend resiliently deforms;

a fluid guide means having a radially exterior edge coupled to the rim engaging means in a coplanar relationship and extending across a portion thereof for guiding fluid from a brush scraped thereagainst back into the container through an aperture in the fluid guide means and for directing fluid poured from the container in a directed stream over the rim of the container, the fluid guide means comprising a depending arcuate guide plate secured to an inner peripheral edge of the inner annular ring and extending downwardly therefrom; an inclined planar guide plate coupled to and extending along a lower inclined edge of the depending arcuate guide plate, with the inclined planar guide plate being positioned at a downward angle relative to a plane containing the annular rings of the rim engaging means; and a dispensing aperture directed through both the depending arcuate guide plate and the inclined planar guide plate at a juncture of the depending arcuate guide plate and the inclined planar guide plate.

* * * * *